United States Patent [19]

Terres et al.

[11] Patent Number: 4,949,649

[45] Date of Patent: Aug. 21, 1990

[54] FOLDING STAGES

[75] Inventors: Mark A. Terres, Bloomington; Paul Thompson, Burnsville; Richard C. Bue, Chaska, all of Minn.

[73] Assignee: Sico Incorporated, Minneapolis, Minn.

[21] Appl. No.: 345,122

[22] Filed: Apr. 28, 1989

[51] Int. Cl.[5] ..... A47B 3/02

[52] U.S. Cl. ..... 108/116; 108/113

[58] Field of Search ..... 108/116, 113, 112, 114, 108/160; 297/159; 248/188.6

[56] References Cited

U.S. PATENT DOCUMENTS

| | | | |
|---|---|---|---|
| Re. 24,454 | 4/1958 | Wilson . | |
| 89,306 | 4/1869 | Goodher . | |
| 770,152 | 9/1904 | Bechtel . | |
| 1,370,732 | 3/1921 | Corbett . | |
| 1,599,247 | 9/1926 | Ridabock . | |
| 1,891,734 | 12/1932 | Slee . | |
| 1,924,945 | 8/1933 | Klotz . | |
| 2,485,193 | 10/1949 | Foglio . | |
| 2,508,627 | 5/1950 | Spiegel et al. . | |
| 2,514,524 | 7/1950 | Steele . | |
| 2,621,095 | 12/1952 | Haumerson . | |
| 2,645,539 | 7/1953 | Thompson . | |
| 2,721,778 | 10/1955 | Wilson . | |
| 2,730,417 | 1/1956 | Mitchell . | |
| 2,739,860 | 3/1956 | Wilson . | |
| 2,747,958 | 5/1956 | Wilson . | |
| 2,764,460 | 9/1956 | Nelson . | |
| 2,766,089 | 10/1956 | Nielsen . | |
| 2,771,937 | 11/1956 | Wilson . | |
| 2,782,075 | 2/1957 | Fagan . | |
| 2,831,741 | 4/1958 | Wilson . | |
| 2,873,157 | 2/1959 | Wilson . | |
| 2,878,859 | 3/1959 | Howe et al. | 297/159 |
| 2,969,245 | 1/1961 | Wilson . | |
| 2,977,169 | 3/1961 | Geller . | |
| 2,978,754 | 4/1961 | Wilson . | |
| 2,983,968 | 5/1961 | Wurn . | |
| 2,993,740 | 7/1961 | Good . | |
| 3,027,209 | 3/1962 | Nielsen . | |
| 3,075,809 | 1/1963 | Wilson . | |
| 3,080,833 | 3/1963 | Risdall . | |
| 3,080,835 | 3/1963 | Guglielmi | 108/116 |
| 3,086,286 | 4/1963 | Schieben, Jr. | 108/112 |
| 3,099,480 | 7/1963 | Wilson . | |
| 3,101,062 | 8/1963 | Kanzelberger | 108/113 X |
| 3,143,982 | 8/1964 | Blink et al. . | |
| 3,245,363 | 4/1966 | Amthor et al. . | |
| 3,276,401 | 10/1966 | Wilson et al. . | |
| 3,337,262 | 8/1967 | Katzfey et al. . | |
| 3,351,029 | 11/1967 | Bue . | |
| 3,437,058 | 4/1969 | Bue . | |
| 3,557,720 | 1/1971 | Blink et al. . | |
| 3,799,073 | 3/1974 | Nielsen . | |
| 3,861,325 | 1/1975 | Bue et al. . | |
| 3,903,812 | 9/1975 | Cowley . | |
| 3,999,491 | 12/1976 | Wilson . | |
| 4,026,221 | 5/1977 | Wilson et al. . | |
| 4,054,096 | 10/1977 | Wilson et al. | 108/113 |
| 4,074,636 | 2/1978 | Wilson . | |
| 4,120,249 | 10/1978 | Blink et al. | 108/113 |
| 4,133,271 | 1/1979 | Carlson | 108/113 |
| 4,327,650 | 5/1982 | Bue . | |

FOREIGN PATENT DOCUMENTS

| | | |
|---|---|---|
| 517072 | 10/1955 | Canada . |
| 1041643 | 10/1958 | Fed. Rep. of Germany . |

*Primary Examiner*—Jose V. Chen

*Attorney, Agent, or Firm*—Merchant, Gould, Smith, Edell, Welter & Schmidt

[57] ABSTRACT

An elevationally adjustable folding stage (30) has two stage surface members (32, 34) which form a planar stage surface. The stage surface members (32, 34) fold to substantially vertical storage position. The stage (30) includes elevationally adjustable telescoping legs (80, 82) which can be adjusted to a number of elevations. Height adjustment pins (128) are remotely released from a location that allows lifting of the stage while simultaneously releasing the height adjustment pins (128) for the corresponding stage surface member. Lifting is aided by lift mechanisms (136) to counter the weight of the stage (30). The stage surface members (32, 34) hinge at a center position and are latched and unlatched by a locking mechanism (150). The locking mechanism (150) uses a spring-loaded member (164) with a finger (170) engaging a cam (172) to guide the sections during folding and biasing a rod (174) to a locked position.

10 Claims, 11 Drawing Sheets

FOLDING STAGES

BACKGROUND OF THE INVENTION

The present invention pertains to the field of mobile elevationally adjustable folding stages, and to improvements therein. Stages generally of this type have come into wide-spread use in schools, hotels, convention centers, and other institutions wherein multiple use facilities require the capability of setting up a temporary stage. Such stages are made up of a number of individual sections which are positioned adjacent each other to make an extended stage surface of whatever size is required. When not in use, the individual sections may be folded to compact dimensions, then set aside for storage. Most such stages are made up of at least two stage surface members hinged together to allow the folding action, and have legs which are also pivoted to either fold out of the way or to remain in floor contact position while the stage surfaces fold to the stage position. Often wheels are provided to make the stage section mobile, so that it can be more easily transported from the use area to a storage area.

Elevationally adjustable folding stages have recently been developed to further increase the utility of the folding stage concept. Examples of such developments Wilson; U.S. Pat. No. 4,026,221 invented by Kermit H. Wilson, Richard C. Bue and Donald R. Carlson; U.S. Pat. No. 4,054,096 invented by Kermit H. Wilson, Ronald R. Carlson, and Richard C. Bue; and U.S. Pat. No. 4,074,636 invented by Kermit Wilson. Although the stages developed to date have been very successful in achieving their object of providing efficient and useful stages, further improvements are still possible, particularly with regard to stages having a very high maximum height, and also in regard to improving the convenience and efficiency in setting up the stage for use.

With regard to the maximum height of the stage, some designs which perform very well in small stages, or ones with a limited range of elevational adjustment, do not readily lend themselves to larger or higher stages, in part because of the need for increased rigidity to prevent swaying or shaking in a tall stage section. Of course all parts can be proportionately strengthened, but the resulting structure is not necessarily the most efficient in terms of weight, cost and difficulty of handling. The present invention provides a stage which is especially advantageous in stages of great height and load carrying capability, although it is equally well adapted for smaller stages.

The height adjustments in elevationally adjustable stages have proven to be difficult to handle for one person. Prior locking mechanisms for locking telescoping legs at a height have required elimination of the downward force of the stage to release a support pin. Each leg requires a support pin that must be released one at a time which may be difficult to do while relieving the downward force as oftentimes the legs are not within reach of one another, and increasing the time and effort required.

Prior folding mechanisms in folding stages have shown that further improvements are possible in releasing and latching stage surface members. The prior stages have demonstrated a need for lift and fold assistance which minimizes the effort required by a person folding the stage or adjusting the height of the stage. An easy way of locking and releasing both height adjusting pins of a stage surface member from a single remote location is needed.

The present invention addresses these problems associated with folding stages. It is apparent that an improved mechanism and method for folding and elevationally adjusting stages is needed. The present invention solves these problems and others associated with folding stages.

SUMMARY OF THE INVENTION

The present invention relates to elevationally adjustable folding stages, and to improvements in folding and lifting of the stages. Two stage surface members are hingable connected along a center line between the two members. In an operation position, the stage surface members form a substantially planar stage surface. When folded, the stage surface members are in a substantially vertical position wherein the undersides of the stage surface members oppose one another. The stage has two support legs for each of the stage surface members and may have folding wheels so the stage can be easily moved. The folding stage has support braces which are adjustable to provide support for the stage members at different heights in an operation position. The braces are adjustable so that they release when the stage members are moved from an operation to a folded position and back to the operation position. The braces are also provided with cross supports which are releasably lockable for adjusting to different elevations. In this respect the elevation of the stage can be adjusted and the stage still provides adequate bracing.

The support legs are elevationally adjusted by having telescoping inner legs extending from the main support legs. Pins insert into holes in the inner telescoping leg and the outer legs for maintaining the stage at a designated elevation. In the operation position, adjustments are made by releasing the pin from each leg of a stage surface member and raising each stage surface member to the desired elevation, the pins are then reinserted for supporting the main support legs relative to the telescoping legs. The pins are connected to a remote releasing mechanism so that both pins for a stage surface member are actuated at a remote location at the edge of the underside of the stage surface member. A sliding handle, which can be gripped while holding the edge of the stage surface member, is pulled toward the edge of the stage surface member to release both pins. In this manner the pins are released by holding to the underside of the edge of the stage surface member and lifting while holding the handle out. When the stage is at the desired height, the handle is released while still holding on to the underside of the edge of the stage surface member so that the resiliently biased pins insert into the desired height adjustment holes.

Lifting is aided by lifting assist means connecting to a lower cross member between the main support legs, and to the underside of the corresponding stage surface member. With the aid of the lifting assist means, raising and lowering the stage requires less effort so that one person can easily lift the stage. A hinge plate, pivotally attached to the upper portion of the lifting assist means and to the stage surface member, allows folding while still providing adequate lifting assistance. The lifting assist means in conjunction with the remote releasing linkage provides for one-person-lifting of the stage. While holding the handle of the releasing mechanism in the release position, a person pushes up or allows the stage surface member to be lowered with the aid of the lifting assist means. When at the desired location, the elevational adjusting mechanism is released so that the pins are placed back in the provided height adjustment holes. The lifting assist means provide enough lifting force so that one person can easily raise and lower the stage surface members. When one side has been raised or lowered, the other side is done in a similar fashion to provide a level stage surface.

Folding of the stage is accomplished by actuating a center handle for lifting the stage surface members and an accompanying folding mechanism into a folded position. The folding handle is attached to a latching mechanism for releasing the stage surface members for folding and includes a latch mechanism for locking the stage surface members in the operation position. The handle extends slightly outward from a side of the stage surface members along a center hinge. By pushing upward on the handle the latch is disengaged from the locked operation position and upward movement of the handle moves the stage surface member to the folded position. The latching mechanism includes a contoured cam engaging a finger on a center member extending from the handle. When the stage surface members are retracted to the fully folded position a side locking arm is swung from the edge of one stage surface member to the other for latching the stage in the folded position. For unfolding, the side locking arm is unlatched and the stage surface members are pulled downward. The center member is spring-loaded so the finger engages the cam of the latching mechanism and guides the member towards the latched position. When reaching the latching position, the member is moved into the locked position wherein an end portion of the member inserts into a hole in a center hinge member, providing additional bracing. Folding is made easier as the lifting assist means provide mechanical advantage in folding the stage as well as lifting.

The support legs and the folding and elevational adjusting mechanisms are positioned within the stage area so that in the operation position, the stage may abut adjacent stages to form a continuous large stage surface. The stage sections include male and female locking members for aligning the adjacent stage sections and positioning them for a continuous stage surface.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings wherein like reference numerals and letters indicate corresponding elements throughout the several views.

DETAILED DESCRIPTION OF THE PREFERRED EMBODIMENT

Figure 1:
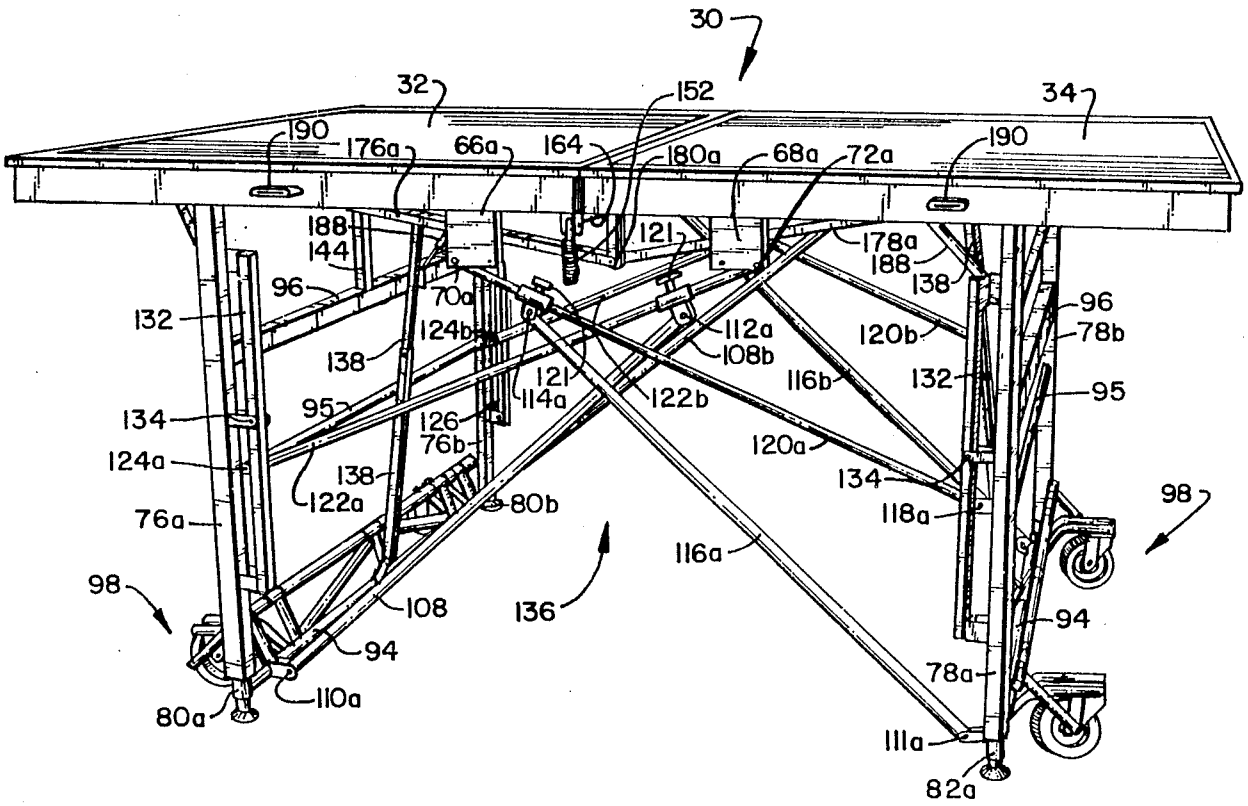
FIG. 1 is a perspective view of an elevationally adjustable folding stage according to the present invention, shown in its unfolded operative position.
Figure 2:
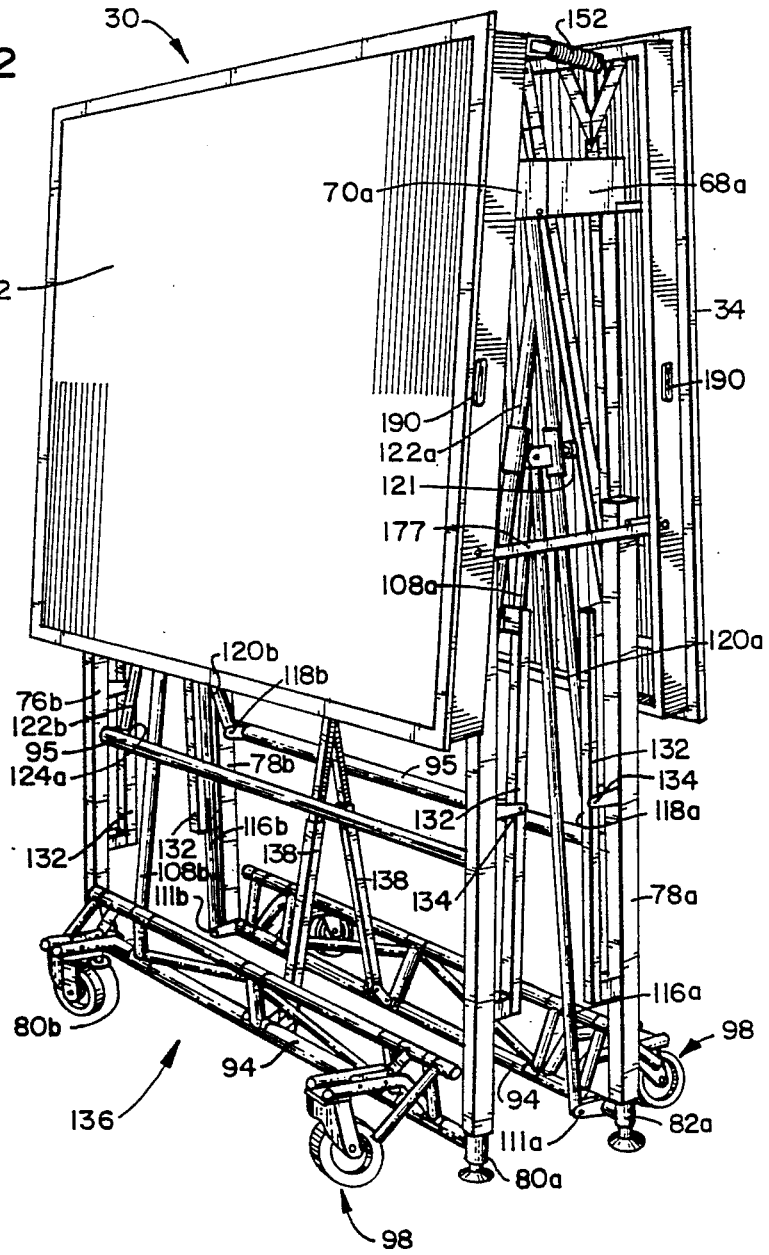
FIG. 2 is a perspective view of the stage of FIG. in its folded position.
Figure 5:
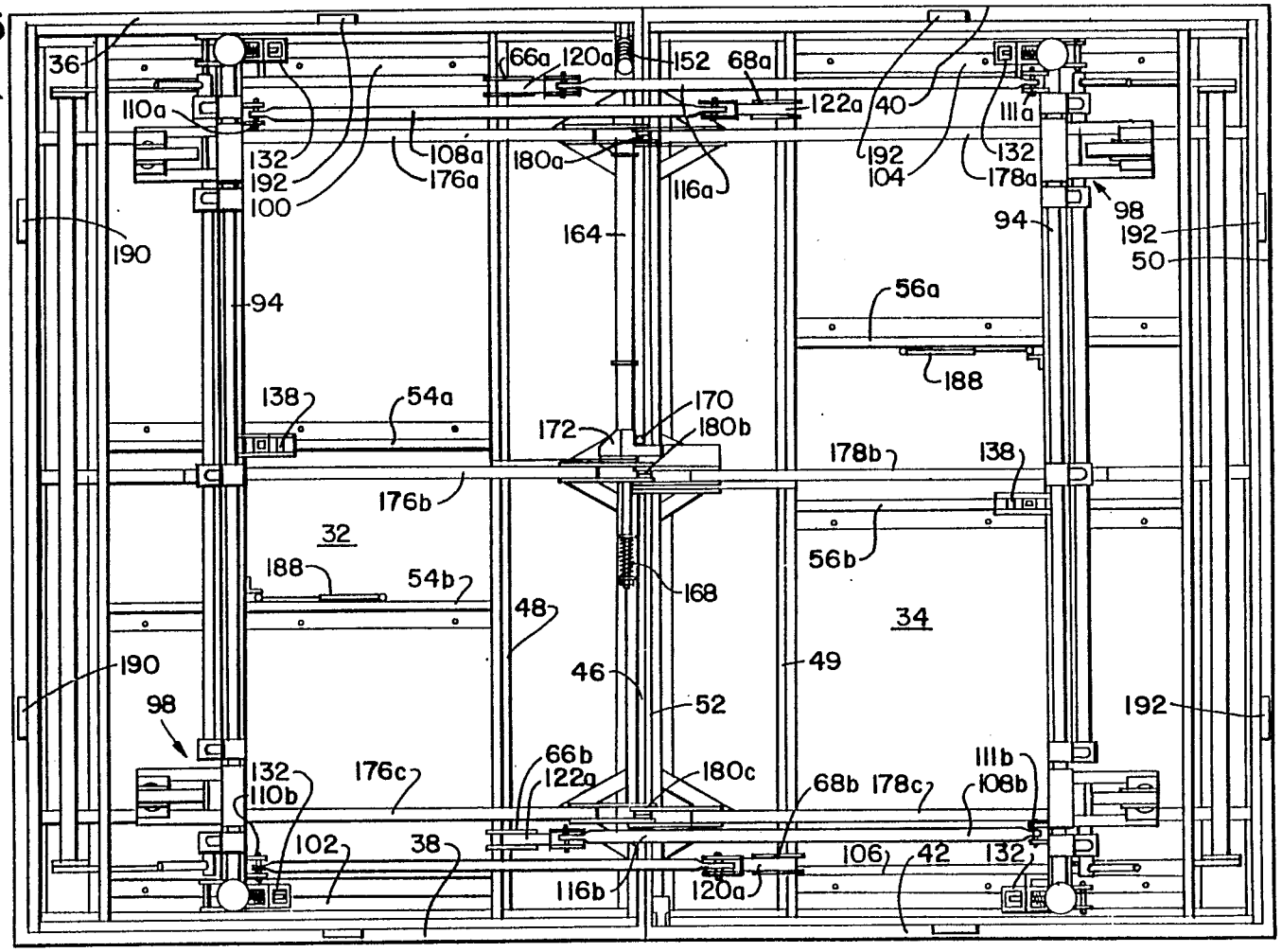
FIG. 5 is a bottom plan view of the stage of FIG. 1 in its operative position.

The overall configuration of the stage according to the present invention is best seen in FIG. 1, which generally shows a stage 30 in its unfolded or operative position, and FIG. 2, which shows the stage 30 in its folded or storage position. The stage 30 comprises a pair of stage surface members 32 and 34. Each stage surface member is a generally rectangular planar member which may be made of any suitable material. The stage surface members 32 and 34 are reversible so that a different top surface may be obtained by having the opposite side with a different surface facing up. Each of the stage surface members 32 and 34 is reinforced underneath by a reinforcing frame made up of a number of pieces of welded iron rails. As seen in FIG. 5, member 32 has side reinforcing rails 36 and 38, while member 34 similarly has side rails 40 and 42. Member 32 has end rails 44 and 46, while member 34 has corresponding end rails 50 and 52. Each stage surface member has an intermediate cross rail 48 and 49 respectively and a pair of intermediately positioned transverse reinforcing rails **54*a* and 54*b*, and 56*a* and 56*b***, respectively.

The reinforcing rails described above are welded together to form a rigid supporting frame for each stage surface member, which may then be bolted or otherwise attached to its respective base frame. It can be appreciated that a number of framework arrangements may be used which provide adequate bracing yet allows folding. The reinforcing base frame also serves as convenient attachment points for the legs, hinges and other hardware items as hereinafter described.

Figure 3:
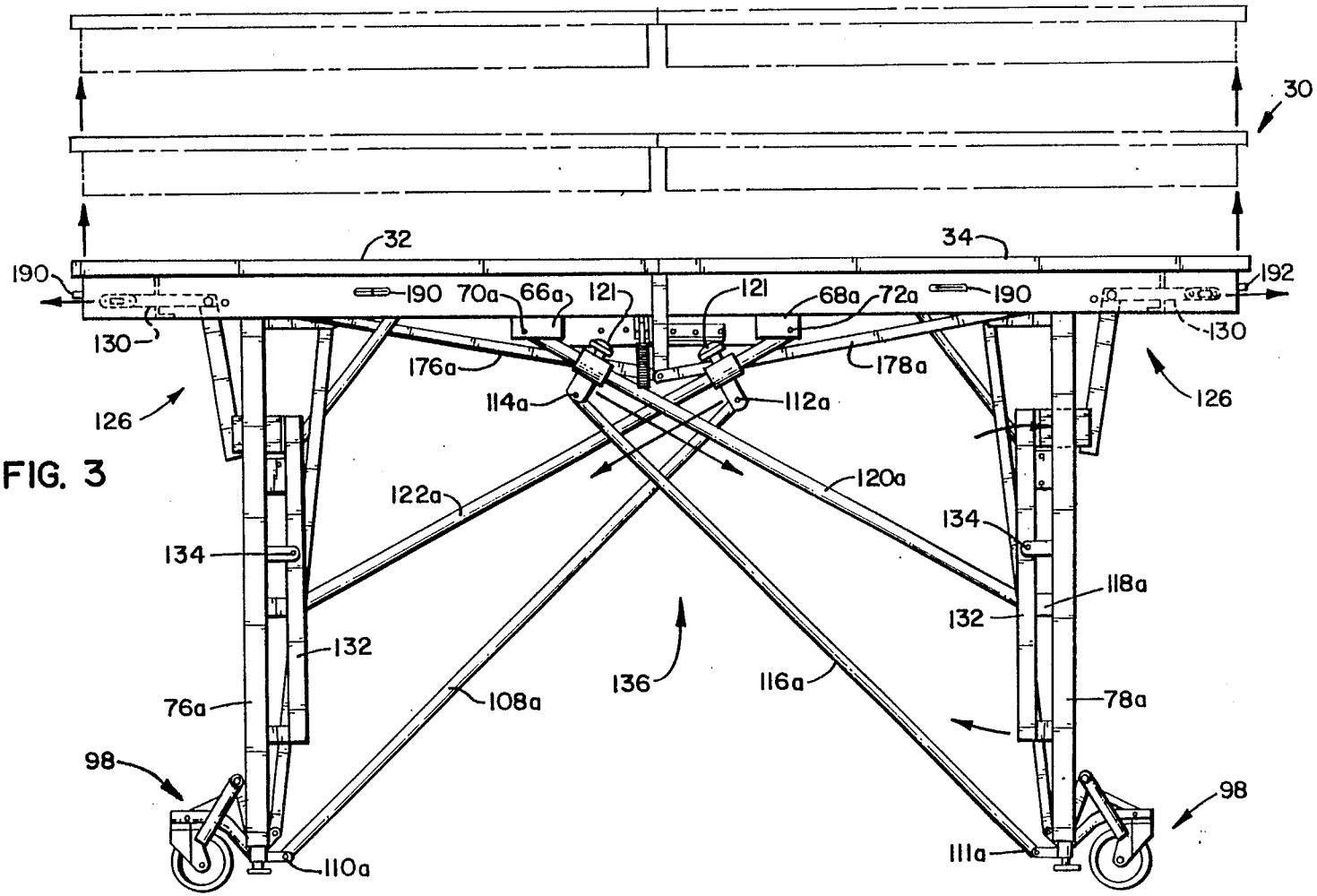
FIG. 3 is a front elevational view of the stage of FIG. 1 in its operative position with different heights shown in phantom.
Figure 4:
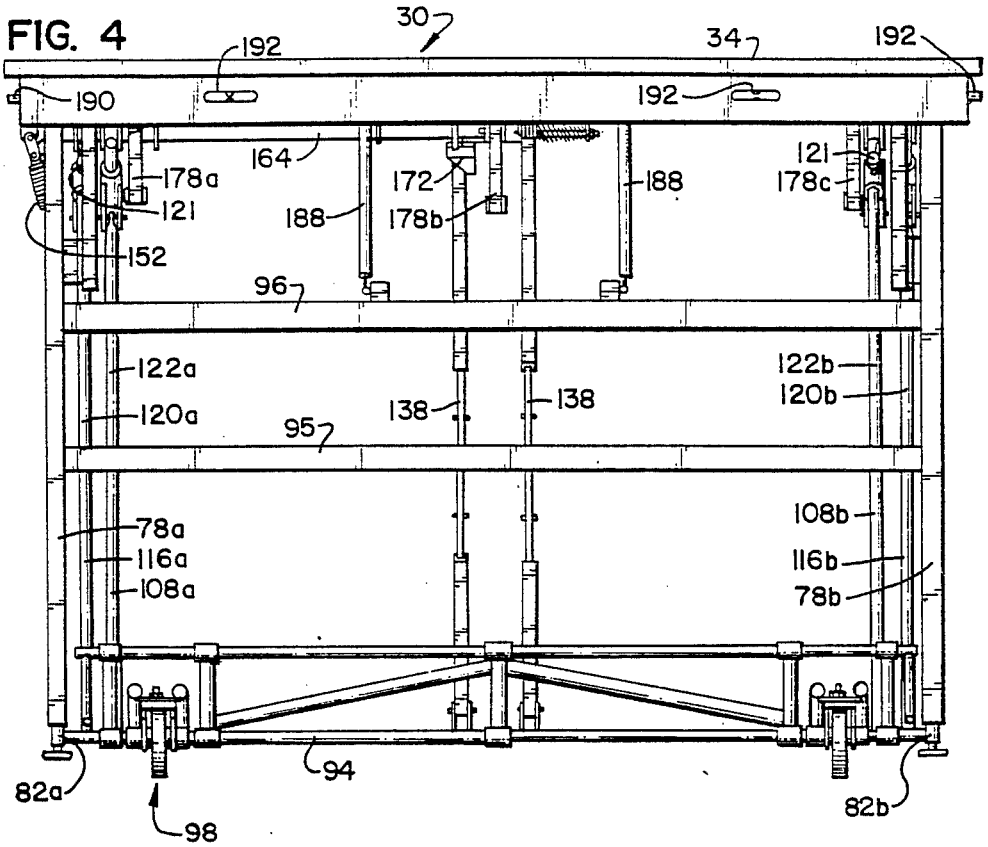
FIG. 4 is a right side elevational view of the stage of FIG. 1 in its operative position.

As shown in FIGS. 3 and 4, the outer edges of the stage surface members 32 and 34 have interlock members attached thereto. The members include male members 190 which lock with female members 192 of an adjacent stage to form a large planar surface.

The stage surface members 32 and 34 are hingably connected to each other along one edge by means of hinge assemblies. As shown in FIGS. 3, 5, and 9–13, three center hinge assemblies provide bracing and guide the stage surface members 32 and 34 during folding.

The hinge assemblies have links 176a, 176b, and 176c attaching to stage surface member 32, and similarly links 178a, 178b, and 178c, attaching to stage surface member 34. The corresponding links attach at center pivots 180a, 180b, and 180c, respectively. The center pivots 180a, 180band 180c also connect to center links 182a, 182b, 182c, and 184a, 184b, 184c, respectively. Center links 182a, 182b, and 182c rigidly attach to the underside of stage surface member 32 along the center edge, similarly center links 184a, 184b, and 184c attach to stage surface member 34. With this arrangement, the stage surface members 32 and 34 are hinged about pivots 180a, 180b, and 180c during folding. The stage surface members are adjusted relative to one another by spacing bolt 186 shown in FIG. 11. The spacing bolt 186 can be adjusted to increase and decrease the spacing of the stage surface members along the center hinge.

As shown in FIG. 1, a pair of hinge plates 66a and 66b are welded to rail 48, and a pair of similar hinge plates 68a and 68b are welded to rail 49 of stage surface member 34. The corresponding hinge plates 66 and 68 are spaced opposite each other but offset slightly so as to overlap. The hinge plates 66 and 68 pivotally attach to the support frame and permit relative movement of the stage surface members 32 and 34 and the support legs 76 and 78 between a compact folded or storage position as indicated in FIG. 2, in which the stage surface members 32 and 34 are generally vertically oriented, and an unfolded or operative horizontal position as indicated in FIG. 1 in which the stage surface members 32 and 34 are horizontal and define a continuous stage surface.

Each of the stage surface members 32 and 34 has a pair of main support legs. For the stage surface member 32, the main support legs comprise a leg 76a and a corresponding leg 76b on the other side as seen in FIG. 1. Similarly, stage surface member 34 has main support legs 78a and 78b. The main support legs may be made for convenience from square metal tubing, as is more clearly seen for example in FIG. 7. Each of the pairs of main support legs 76a, 76b, and 78a, 78b are interconnected by a cross brace, such as brace 94 in FIG. 1, at the lower portion of the main support legs. Each brace 94 is pivotally attached to a wheel mechanism 98. The wheel mechanism 94 is rotated to a rolling position to support the stage 30 for mobility. An upper cross brace 96 and intermediate brace 95 are also provided between the legs of each pair of main support legs.

Each of the main support legs is hingeably connected to reinforcing rails underneath their respective stage surface members. Referring specifically to FIG. 5, additional reinforcing rails 100 and 102 are positioned adjacent rails 36 and 38, respectively, beneath member 32. Similarly, reinforcing rails 104 and 106 are positioned adjacent rails 40 and 42, respectively, beneath stage surface member 34. The leg 78a pivots about a pivot bolt (not shown). A construction similar to that just described exists with respect to each of the other three main support legs.

Figure 6:
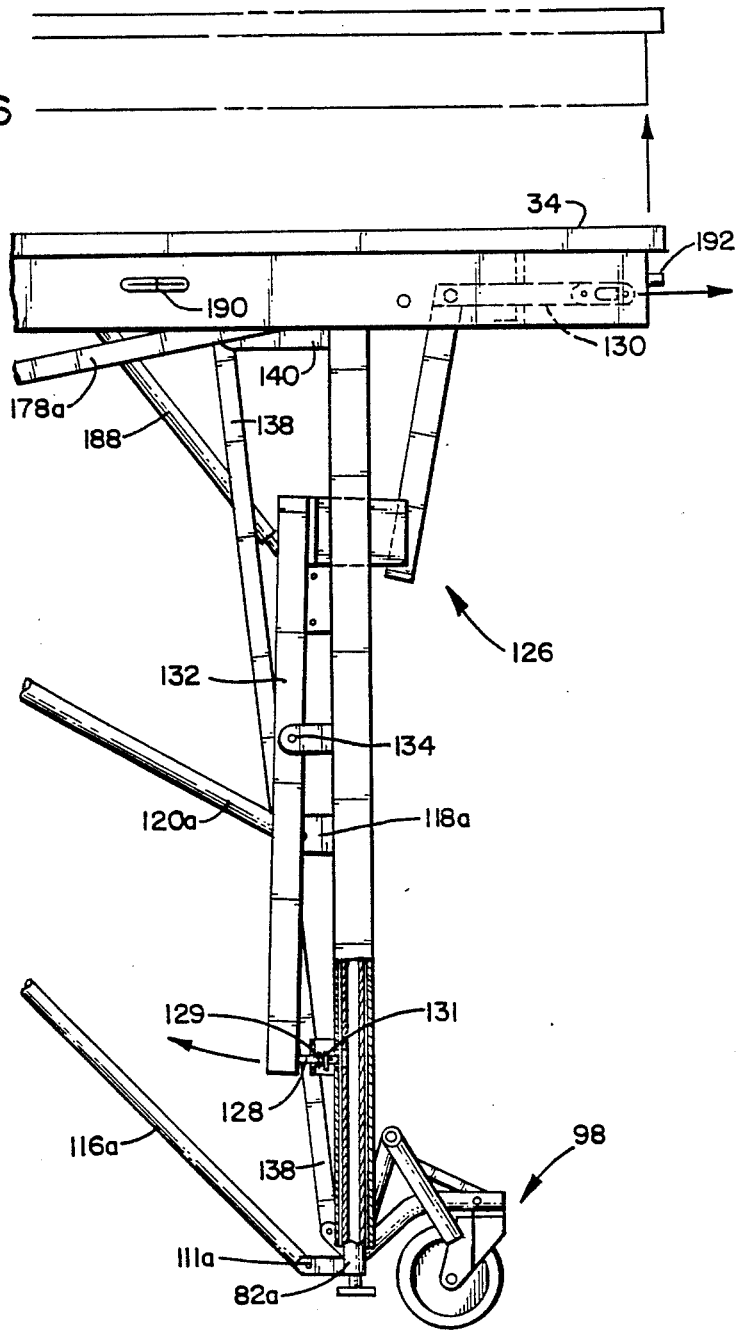
FIG. 6 is a detail of the lock releasing mechanism for the stage of FIG. 1.

Referring to FIGS. 1 and 3, a plurality of cross connect links are seen interconnecting the stage surface members to the main support legs of the opposite stage surface member. Cross connect links 108a and 108b are connected by pivots to the lower portions of main support legs 76a and 76b; link 108a is connected by pivot 110a, and link 108b is connected by a similar pivot (not shown). In a similar manner cross connect links 116a and 116b connect to pivots 111a and 111b, respectively. The upper ends of links 108a and 108b are attached by means of pivots 112a and 112b to cross connect links 120a and 120b respectively. Pivots 112a and 112b are adjustable and may be loosened for adjustment by loosening a set pin 121. Similarly, the upper ends of cross connect links 116a and 116b connect by means of pivots 114a and a similar pivot (not shown) to cross connect links 122a and 122b respectively. The lower ends of links 120a and 120b connect by means of pivots 118a and a similar pivot (not shown) to the horizontal brace 95 which interconnects the main support legs 78a and 78b. In similar fashion, the lower ends of cross connect links 122a and 122b connect by means of pivots 124a and 124b to cross brace 95 which interconnects main support legs 76a and 76b. The upper end of cross connect links 120 and 120b connect at pivots 70a and 70b of hinge plates 66a and 66b, respectively. In a similar manner, cross connect links 122a and 122b connect at pivots 72a and 72b of hinge plates 68a and 68b respectively. The main support legs 76a and 76b are elevationally adjustable by raising or lowering the legs 76a and 76b, and 78a and 78b relative to telescoping inner legs 80a and 80b, and 82a and 82b, respectively. As shown in FIG. 6, pins 128 insert into the main support leg and the telescoping leg to adjust the height of the stage.

Elevational adjustment pins 128 are released at a remote location in a preferred embodiment. As shown in FIG. 6, release mechanism 126 is connected to pin 128 and to the corresponding pin (not shown) on the corresponding leg for each stage surface member so that both pins 128 may be removed during elevational adjustment from a single remote location. The release mechanism 126 is actuated from a single sliding handle 130 at a location near the edge of the stage surface member 32 or 34. With this arrangement, the sliding handle 130 may be actuated while at the same time lifting on the edge of the stage surface member 32 or 34.

Figure 7:
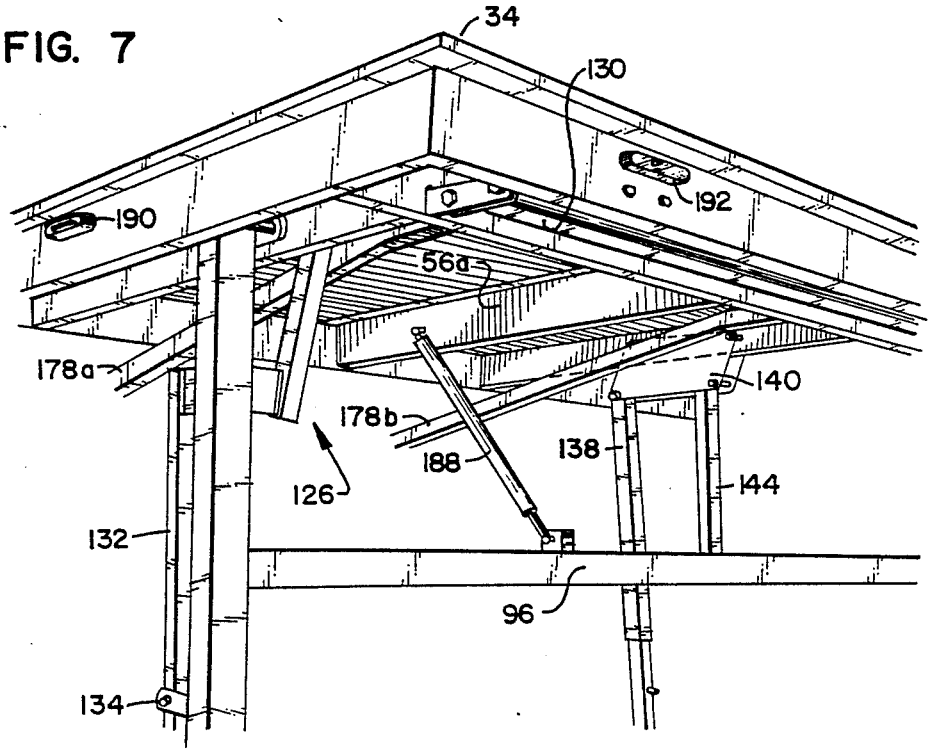
FIG. 7 is a detail of the underside of a stage surface member of the stage of FIG. 1.

With the aid of lift mechanism 136, the stage 30 is elevationally adjusted by gripping an edge of the stage surface member, grasping the handle 130 to release the pins 128, and lifting or lowering the associated stage surface member. The release mechanism 126 has horizontal handle 130 sliding parallel to the stage surface member. The handle 130 is hingeably connected to intermediate member 132. The intermediate member 132 hingeably connects to pins 128 at the end opposite the sliding handle 130. The intermediate member 132 pivots about an intermediate pivot 134 on the main support leg so that sliding the handle 130 toward the edge of the stage surface member moves the upper end of the intermediate member 132 toward the edge of the stage surface member and pivots the opposite end toward the center of the stage, releasing the pins 128. The pins 128 are biased toward an inserted position by an expansion spring 129. The spring 129 resiliently engages a flange or washer 131 of pin 128 to insert the pin 128 into the main support leg and telescoping leg. The intermediate member 132 is bent around the main support leg 78a at the top end, as shown in FIG. 7, so that the leg does not limit the motion of the intermediate member 132. The intermediate members 132 bend around the other legs in a similar manner.

Figure 14:
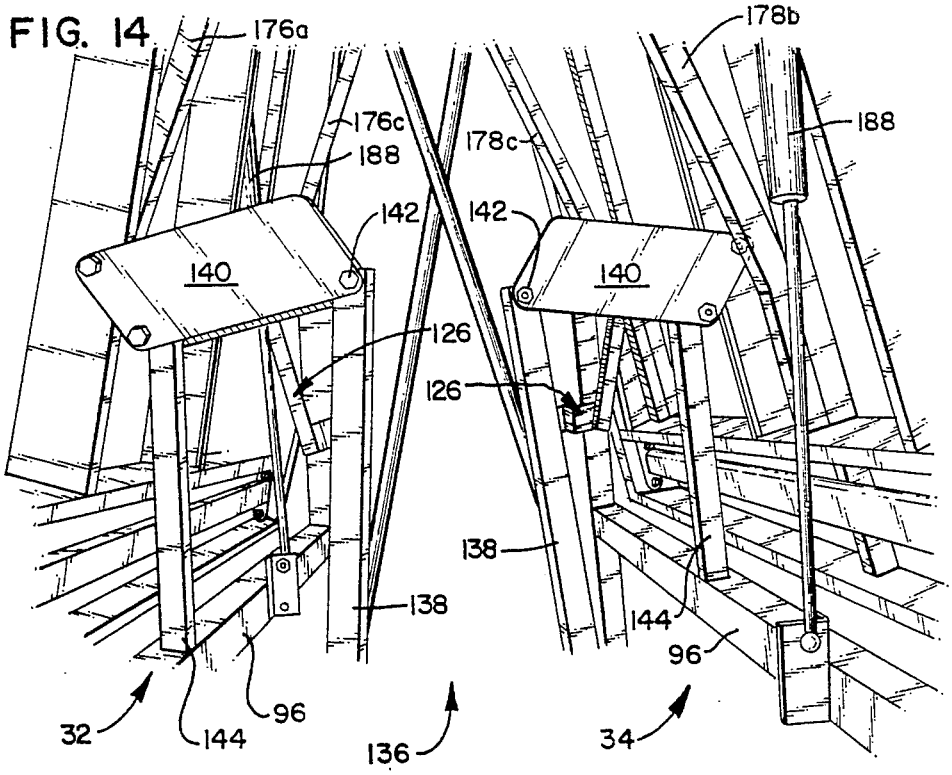
FIG. 14 is a side view of a detail of lift assist mechanisms of the stage of FIG. 1 in a folded position.
Figure 15:
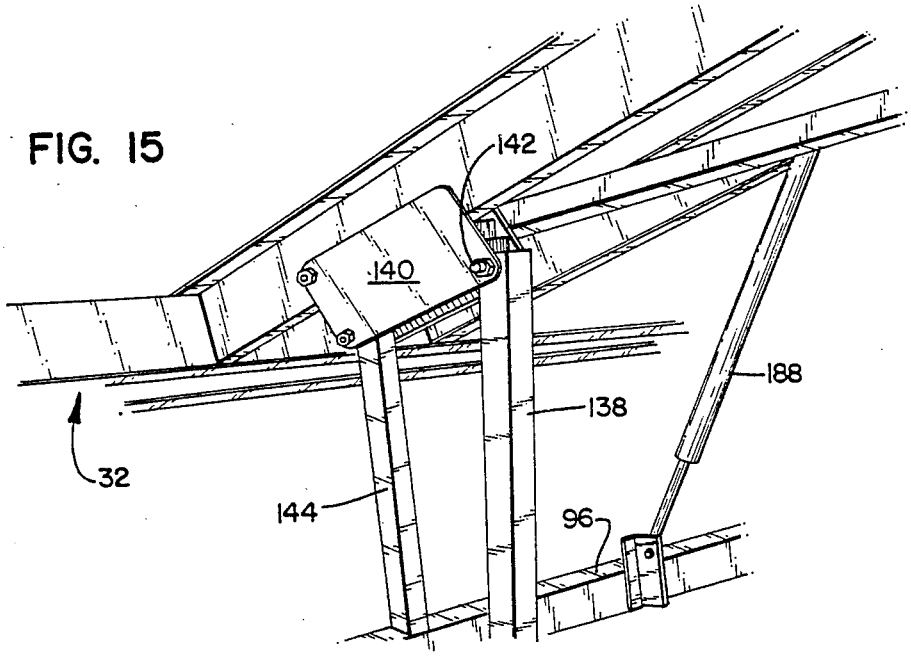
FIG. 15 is a perspective view of a detail of the lift assist mechanism of FIG. 14.

As shown in FIGS. 3, 14 and 15, lift mechanisms 136 are used to aid in elevational adjustments. The lift mechanisms 136 include lift members 138 hingeably attached to leg cross members 94, and to hinge plates 140. In the preferred embodiment, each lift mechanism 136 utilizes a pair of gas springs (not shown) mounted within lift member 132. The gas springs are mounted end to end within the lift member to provide greater expansion and contraction and thus greater elevational adjustment. Additional lift and bracing are provided by similar additional gas springs 188 attached to brace 96 and the underside of the corresponding stage surface member. In the preferred embodiment, the gas springs are sized so that the lifting force required of a worker is minimized.

As shown in FIGS. 14 and 15, the lift members 138 attach to the hinge plates 140 to provide for pivoting the lift mechanisms 136 to the folded position. The hinge plates 140 are formed of two plates attached by bolts to the rails 54*a* and 54*b*, respectively. Bolt 142 forms a stop against the rail to limit movement of the hinge plate 140 as shown in FIG. 15. The hinge plates 140 pivot to a position for folding and is stopped by member 144. Lift members 138 extend and contract during folding to provide for movement between an operation position and a folded position.

Figure 8:
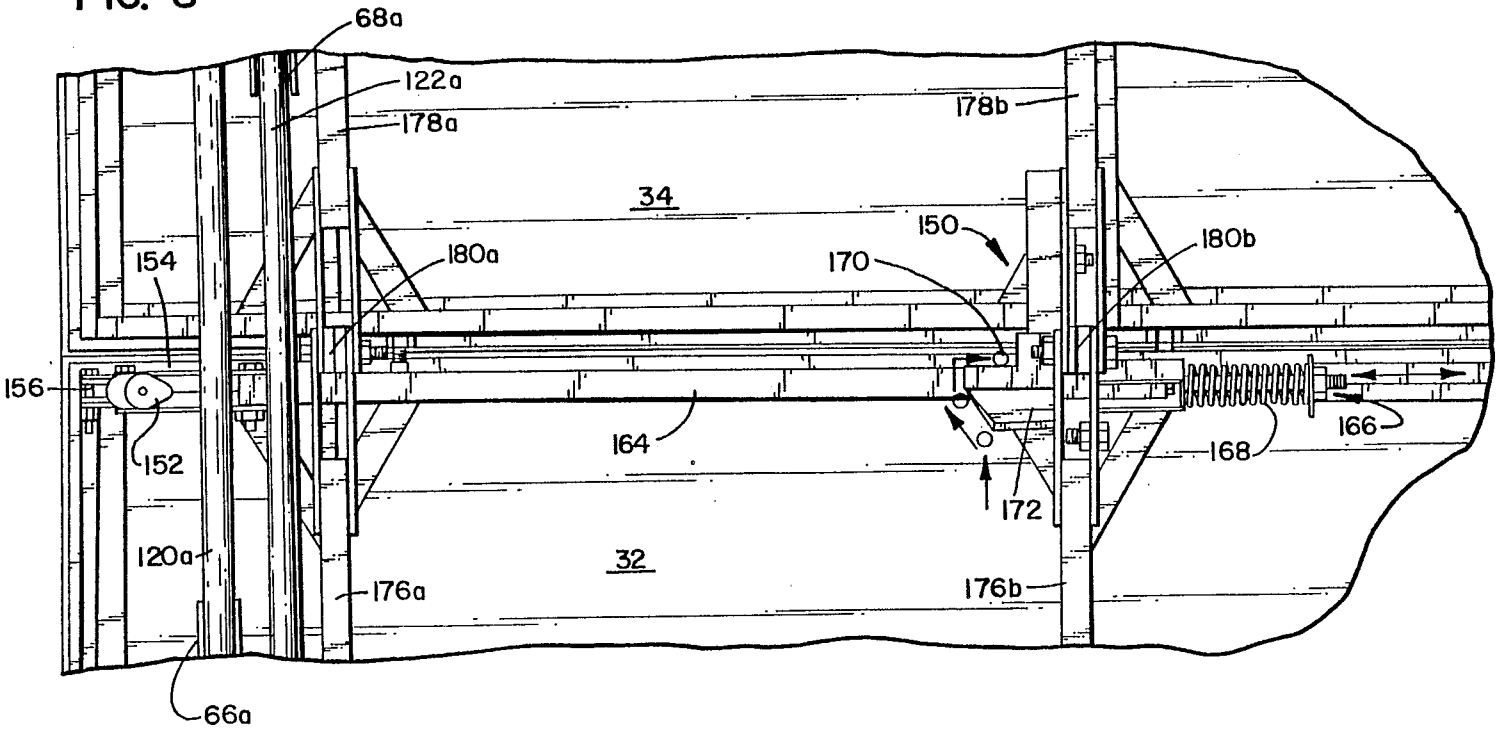
FIG. 8 is a bottom detail of folding mechanism of the stage of FIG. 1 in its latched position.
Figure 9:
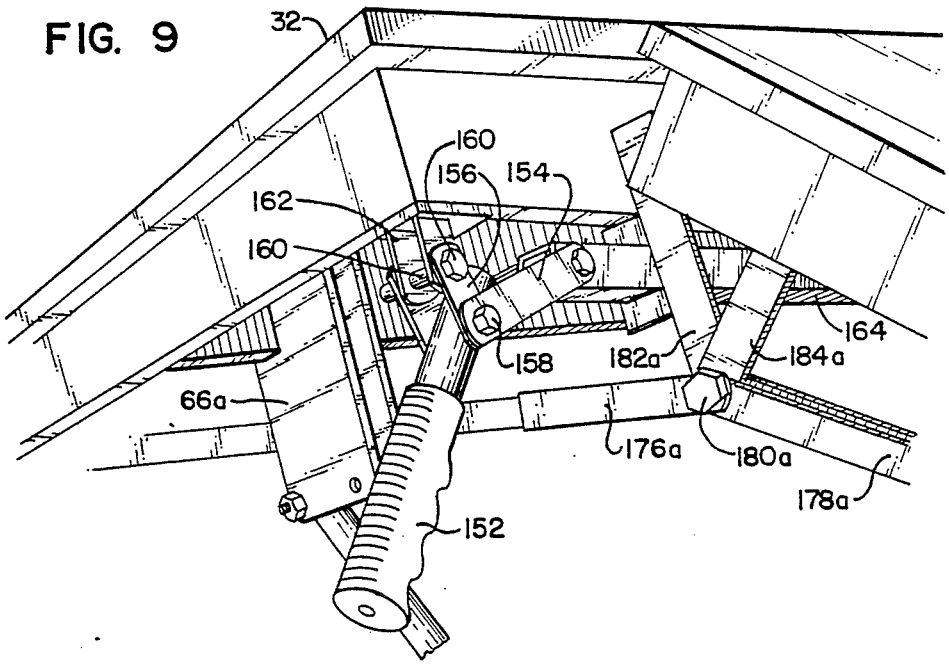
FIG. 9 is a perspective view of the handle of the folding mechanism of FIG. 8 in a partially folded position.
Figure 11:
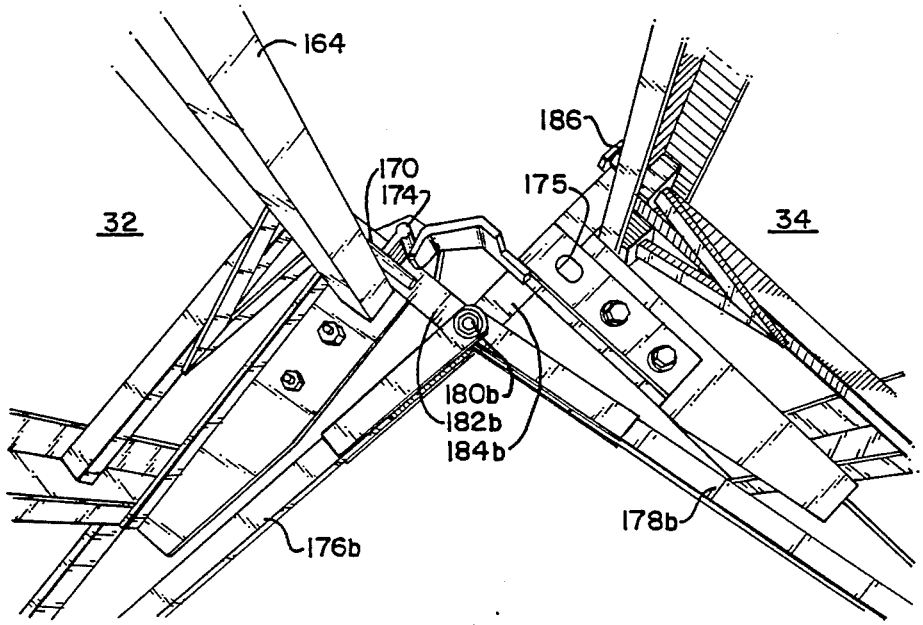
FIG. 11 is a side perspective view of the folding mechanism of FIG. 8 in an unfolded position.

Referring now to FIGS. 8–13, folding mechanism 150 is shown for locking the stage 30 in an operating position. As shown in FIG. 9, the folding mechanism 150 utilizes handle 152 for actuating the mechanism 150 to lock and release the stage surface members. The handle attaches to links 154 and 156 at pivot 158. The link 156 attaches to pivot 160 on tab 162 attached to the underside of the stage surface member 32. The link 154 attaches to member 164 which extends to the latching mechanism.

Figure 10:
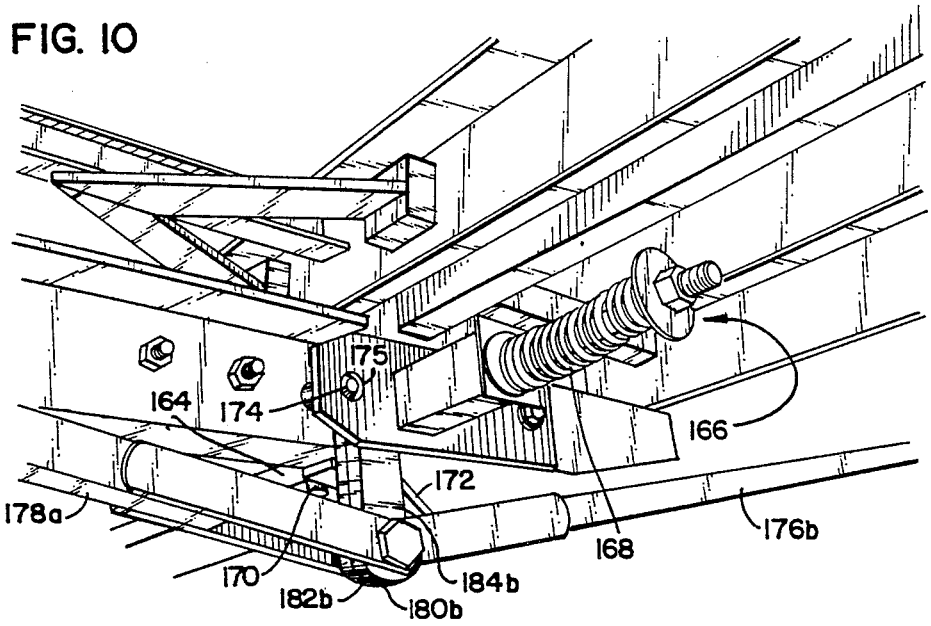
FIG. 10 is a perspective view of the spring portion of the folding mechanism of FIG. 8 in its latched position.
Figure 12:
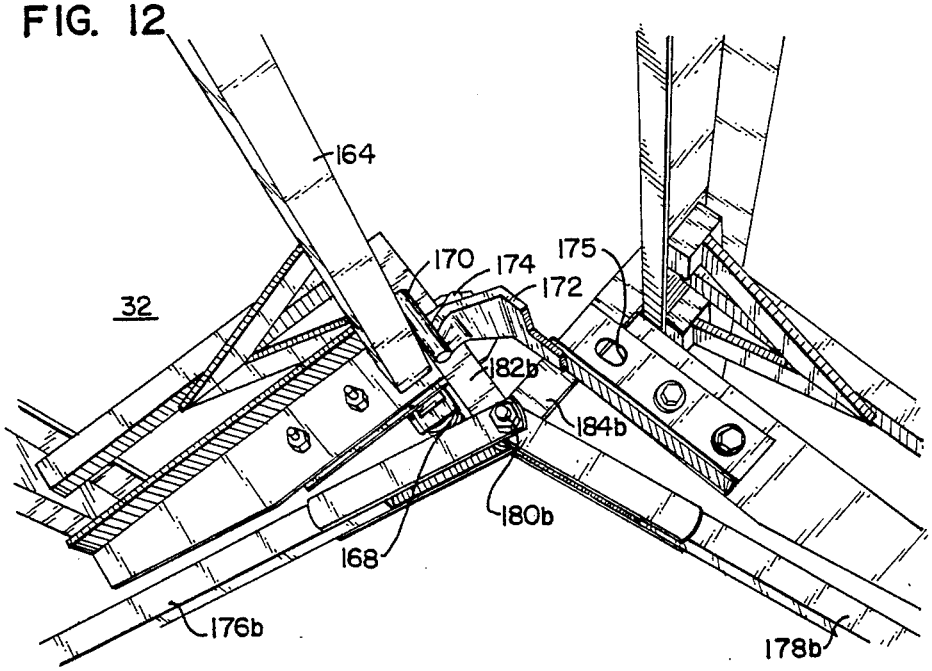
FIG. 12 is a side perspective view of the folding mechanism of FIG. 8 in a partially folded position.
Figure 13:
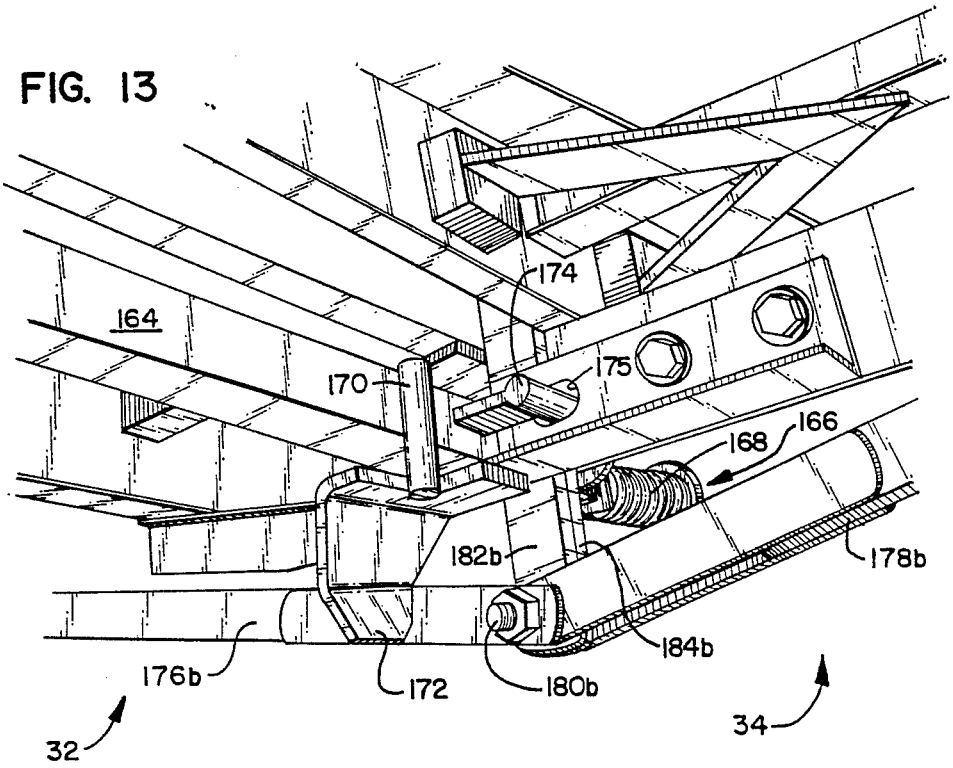
FIG. 13 is a perspective view of the latch portion of the folding of FIG. 8.

As shown in FIG. 10, the member 164 has an extension 166 which engages spring 168 so that the member 164 is under tension and pulled inward toward the center of the stage 30. In this manner, finger 170 projecting from member 164 is pulled against cam 172 as shown in FIGS. 8 and 12. The cam 172 is shaped so that it widens as the finger 170 is moved toward a locking position. With the spring 168 providing pressure to the finger 170 against the cam 172, the stage will not slip down from an unfolded position. The spring 168 pulls the member 164 inward so that the finger 170 is pulled into a locking position when passing the corner of the cam 172 as shown in FIG. 13. In this manner,, rod 174 extending from member 164 is forced into hole 175 in the locked operative position and provides added bracing and safety to the stage 30. To unlock the latch and remove rod 174 and finger 170 from the locked position, the handle 152 is pulled upward to a release position. The handle 152 is used to lift and pull the stage 30 into the folded position shown in FIG. 2. A side locking arm 177 is then swung into a locked position and hooked to a pin (not shown) to prevent the stage 30 from unfolding.

It can be seen then, that the present invention provides a folding stage having an improved folding and latching mechanism. The present invention also provides a remote locking and releasing mechanism for easier elevational adjusting of the stage. With lifting assist means, easy single person elevational adjustment and folding are provided for with minimum effort.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An elevationally adjustable stage comprising:

(a) a pair of generally planar stage surface members;

(b) means hingeably connecting the stage surface members for movement between an operative position in which the stage surface members co-jointly define a common stage surface, and a folded position;

(c) main support legs associated with each of the stage surface members;

(d) means hingeably mounting the main support legs to the stage surface members for allowing movement of the stage surface members to their folded position;

(e) cross connect link means pivotally connected to the main support legs and to the underside of the opposite stage surface member for holding the legs approximately vertical in both the operation and folded position;

(f) elevationally adjustable lower support legs telescopically positioned within the main support legs, whereby the lower support legs include means for locking the position of lower support legs relative to the main support legs;

(g) a plurality of stabilizing braces having means pivotally connecting first ends thereof to the lower support legs and having means for slidably connecting the other ends thereof to the cross connect link means;

(h) means for locking the slidably connected ends of the stabilizing braces to the cross connect link means according to the elevational adjustment of the stage;

(i) elevational lifting means connected to the stage surface members and said main support legs for aiding raising of the stage surface members; and, (j) releasing means for unlocking the elevationally adjustable lower support legs from the main support legs, wherein the releasing means is actuated by a remote locking release means from a location proximate the underside of the edge of stage surface member.

2. An elevationally adjustable stage, comprising:

(a) a pair of planar stage surface members;

(b) hinge means connecting adjacent edges of the pair of stage surface members for movement between an operative position in which the stage surface members are coplanar to define a common stage surface, and a folded position in which the undersides of the stage surface members face each other;

(c) main support legs for each of the stage surface members, and means pivotally connecting the support legs to the respective stage surface member at a position remote from the hinge means;

(d) a plurality of cross connect links and means pivotally connecting the links to the support legs and to the underside of the opposite stage surface member;

(e) elevationally adjustable lower support legs telescopically positioned within the main support legs;

(f) brace means connected to the lower support legs and to the cross connect links for stabilizing the support legs with respect to the opposite stage surface member;

(g) means for adjusting the point of connection o the brace means to the lower support legs in accordance with different elevationally adjusted positions of the lower support legs;

(h) lifting means connected to the stage surface members and said main support legs providing lift during elevational adjusting and folding of the stage surface members;

(i) locking means for locking the position of the lower support legs relative to the main support legs, whereby upon releasing the locking means, the elevation of the stage surface members may be raised or lowered; and (j) remote locking release means for releasing and actuating the locking means at a location remote from the locking means.

3. A stage according to claim 2, wherein the lift means comprise gas springs connected to the stage surface member and the support legs for the stage surface member.

4. A stage according to claim 2, wherein the remote locking release means comprise:

(a) a pin slidably engaging a slot in the main support leg and the lower support leg and connected to a remotely actuated handle means; and, (b) biasing means engaging a flange of the pin, biasing the pin toward an inserted locked position.

5. A stage according to claim 4, wherein the remote locking release means comprise:

(a) a pin engaging member pivotally connecting to the pin at a first end of the pin engaging member the pin engaging member pivoting about an intermediate point proximate the main support leg, wherein the pin engaging member bends around the main support leg at the end opposite the pin so that upon pivoting the pin engaging member to release the pin, the motion of the pin engaging member is not limited by the leg; and, (b) sliding handle means slidably engaging a lower side of the stage surface member, the sliding handle means pivotally connecting to the pin engaging member at a second end of the pin engaging member, so that sliding the handle means from an at rest position pivots the pin engaging member to the release position to release the pin and provide for adjustment of the lower support leg relative to the main support leg.

6. An apparatus according to claim 5, wherein the sliding handle means comprises a horizontal bar sliding substantially parallel to the pin.

7. An apparatus according to claim 6, wherein the horizontal bar attaches to a plurality of pin engaging members, each pin engaging member engaging the corresponding pin.

8. A stage according to claim 2, further comprising folding means for moving the stage between a storage position and an operative position, extending proximate the center edges of the stage surface members, including slidable arm means having a pivotally connected handle mechanism at a first end, and a rod portion and a radially extending finger portion near a second end, wherein the slidable arm is resiliently biased so that the radially extending finger portion engages a cam extending down from a first stage surface member, wherein the cam has a locking edge and a contoured edge so that the radially extending finger portion rides along the contoured edge of the cam and is guided to a locked position along the locking edge of the cam so that the rod portion is guided to a latched position whereat the rod portion engages an underside member of a second stage surface member having an aperture receiving the rod portion, thereby locking the stage in an operative position.

9. A stage according to claim 8, wherein the handle mechanism pivotally connects to the slidable arm means so that upon lifting the handle, and the finger and rod portions are released and upon pushing the handle down, the slidable arm and finger and rod portions are moved to the locked position.

10. A stage according to claim 9, wherein the handle mechanism remains extended following release of the slidable arm and finger and rod portions, so that pushing up on the handle mechanism raises the stage surface members to the folded position.

* * * * *

UNITED STATES PATENT AND TRADEMARK OFFICE

CERTIFICATE OF CORRECTION

PATENT NO. : 4,949,649

DATED : August 21, 1990

INVENTOR(S) : Terres et al.

It is certified that error appears in the above-identified patent and that said Letters Patent is hereby corrected as shown below:

Column 1, line 26
INSERT --are found in U.S. Pat. No. 3,999,291 invented by Kermit H.-- after "developments"

Column 3, line 64
INSERT --1-- after "Fig."

Column 4, line 21
INSERT --mechanism-- after "folding"

Column 6, line 15
"120" should read --120a--

Column 7, line 42
delete "," before "rod"

Column 8, line 19
"position" should read --positions--

Column 8, line 65
"o" should read --of--

UNITED STATES PATENT AND TRADEMARK OFFICE

CERTIFICATE OF CORRECTION

PATENT NO. : 4,949,649

DATED : August 21, 1990

INVENTOR(S) : Terres et al

It is certified that error appears in the above-identified patent and that said Letters Patent is hereby corrected as shown below:

Column 10, line 32
delete "and" after "handle"

Signed and Sealed this

Nineteenth Day of May, 1992

*Attest:*

DOUGLAS B. COMER

*Attesting Officer*

*Acting Commissioner of Patents and Trademarks*